US006890266B2

(12) United States Patent
Solheim et al.

(10) Patent No.: US 6,890,266 B2
(45) Date of Patent: May 10, 2005

(54) METHODS AND APPARATUS FOR A METAL WOOD-TYPE GOLF CLUB

(75) Inventors: John A. Solheim, Phoenix, AZ (US); Anthony D. Serrano, Peoria, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 10/444,436

(22) Filed: May 23, 2003

(65) Prior Publication Data

US 2004/0235582 A1 Nov. 25, 2004

(51) Int. Cl.[7] ..... A63B 53/02
(52) U.S. Cl. ..... 473/246; 473/305; 473/345
(58) Field of Search ..... 473/308–311, 305, 473/244–248, 345–346

(56) References Cited

U.S. PATENT DOCUMENTS

| | | | | |
|---|---|---|---|---|
| 3,640,534 A | | 2/1972 | Mills | |
| 3,759,517 A | | 9/1973 | Mills | |
| 3,810,621 A | | 5/1974 | Mills | |
| 3,819,181 A | | 6/1974 | Mills | |
| 5,335,909 A | | 8/1994 | Green, Jr. | |
| 5,452,890 A | | 9/1995 | Bingman | |
| 5,538,246 A | | 7/1996 | Dekura | |
| 5,575,723 A | | 11/1996 | Take et al. | |
| 5,626,528 A | | 5/1997 | Toulon | |
| 5,658,207 A | | 8/1997 | Aizawa et al. | |
| 5,766,089 A | | 6/1998 | Dekura | |
| 5,797,806 A | | 8/1998 | Butler | |
| 5,839,973 A | | 11/1998 | Jackson | |
| 5,851,155 A | | 12/1998 | Wood et al. | |
| 5,855,526 A | | 1/1999 | Honma | |
| 5,885,169 A | * | 3/1999 | Ishizuka | 473/305 |
| 5,906,549 A | | 5/1999 | Kubica | |
| 5,931,742 A | * | 8/1999 | Nishimura et al. | 473/305 |
| 6,077,172 A | | 6/2000 | Butler | |
| 6,244,976 B1 | | 6/2001 | Murphy et al. | |
| 6,273,828 B1 | | 8/2001 | Wood et al. | |
| 6,299,546 B1 | | 10/2001 | Wang | |

FOREIGN PATENT DOCUMENTS

| | | |
|---|---|---|
| GB | 2197209 A | 11/1987 |
| GB | 2207358 A | 7/1988 |
| GB | 2225726 A | 12/1988 |
| GB | 2230459 A | 4/1989 |

OTHER PUBLICATIONS

Internet Web page www.butlergolf.com/tech–2.html entitled "The Art of Form & Function".

* cited by examiner

*Primary Examiner*—Stephen Blau
(74) *Attorney, Agent, or Firm*—Darrell F. Marquette

(57) ABSTRACT

A wood-type golf club head includes a substantially hollow body wherein the hosel is substantially isolated from the top wall of the body. The hosel is attached to the heel region of the bottom wall and extends upwardly through a hosel cavity. A hosel sleeve is preferably provided to substantially isolate the top wall of the club head body from the hosel.

9 Claims, 2 Drawing Sheets

METHODS AND APPARATUS FOR A METAL WOOD-TYPE GOLF CLUB

BACKGROUND OF THE INVENTION

1. Technical Field

This invention relates, generally, to golf clubs and, in particular, to an improved metal wood-type golf club.

2. Background Information

Modern wood-type golf club heads almost exclusively consist of a hollow metallic club head fixed to a shaft via a hosel that is rigidly attached (or integral with) the club head body. When the club head face strikes a golf ball, the various walls of the club head body experience an impulse response. For example, the top wall of the club body experiences a response characterized by the propagation of one or more waves across its surface. Because of the configuration of the hosel with respect to the club head body in traditional wood-type club heads, including the rigid attachment of the hosel to the top wall, the resulting wave propagation in prior art golf clubs is unsatisfactory and results in a significant loss of energy and, necessarily, the club head's coefficient of restitution.

As is known in the art, the coefficient of restitution (or "COR") is used to characterize the efficiency of impact between two bodies (e.g., a golf club head and a golf ball). The COR quantifies the extent to which an impact is elastic by comparing the total energy of the colliding bodies before and after a collision. A perfectly elastic collision, for example (with no energy loss), would exhibit a COR of 1.0.

In this regard, the United States Golf Association (USGA) has promulgated rules that limit the COR for certain club heads. See, e.g., USGA Rule 4-1(a), Appendix II, and "USGA Procedure for Measuring the Velocity Ratio of a Club Head," rev. 2 (February 1999), the contents of which are hereby incorporated by reference.

Regardless of whether a particular club head is subject to a maximum permissible COR, it is desirable to achieve a suitably high COR without compromising other design goals. Some prior art wood-type club heads are unsatisfactory in this respect as their hosel configurations tend to increase energy loss, thereby reducing their effective COR.

BRIEF SUMMARY OF THE INVENTION

The present invention generally provides a hollow-body golf club head, for example, a wood-type golf club head, wherein the hosel is substantially isolated from the top wall or crown and the side wall or skirt of the body. In accordance with one aspect of the present invention, the hosel is attached to the heel region of the bottom wall or sole and extends upwardly through a hosel cavity. A hosel sleeve is preferably provided to substantially isolate the top wall and the side wall of the club body from the hosel.

BRIEF DESCRIPTION OF THE DRAWINGS

The subject invention will hereinafter be described in conjunction with the appended drawing figures, wherein like numerals denote like elements, and.

DETAILED DESCRIPTION

The present invention generally provides a golf club head of the type having a substantially hollow body, wherein the hosel is suitably isolated from the top wall of the body. In accordance with one aspect of the present invention, the hosel is attached, integrated with, or otherwise mechanically coupled to the heel region of the bottom wall and is configured to extend upwardly through a hosel cavity which, in various embodiments, has a suitable hosel sleeve provided therein to substantially isolate the top wall of the club body from the hosel.

Figure 1:
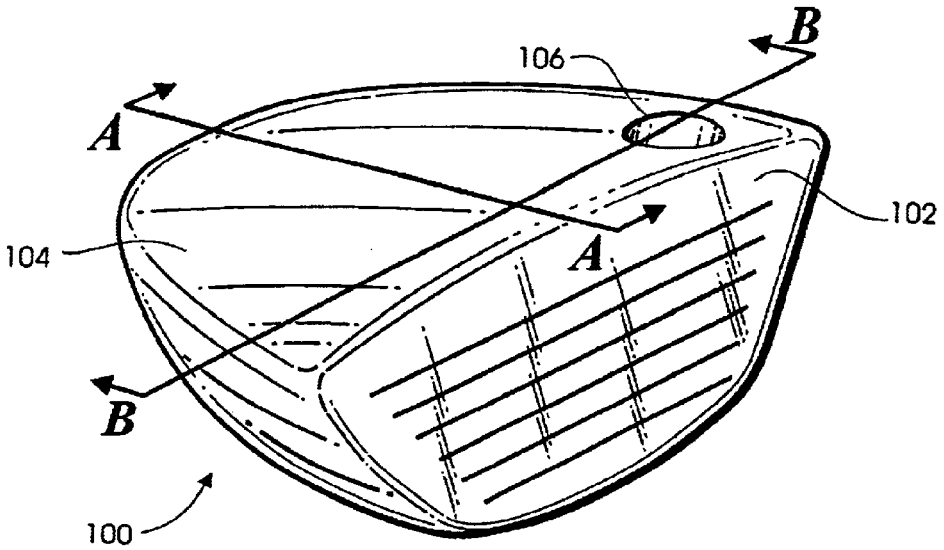
FIG. 1 is a perspective overview of a club head in accordance with various aspects of the present invention.
Figure 2:
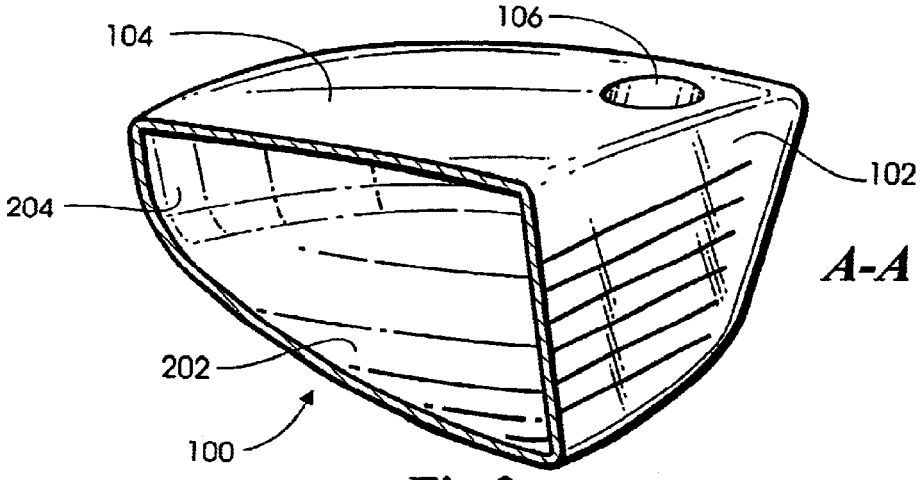
FIG. 2 is a cut-away view through section A—A of the club head shown in FIG. 1.

Referring now to FIG. 1, a club head body 100 in accordance with the present invention generally includes a front wall (or "face") 102, a top wall 104, and a hosel cavity 106 formed within top wall (or "crown") 104. As shown in FIG. 2, which depicts a cut-away view of cross-section A—A, club head body 100 is substantially hollow and has an inner surface 202 of a bottom wall (or "sole") extending from front wall 102 rearward to side wall (or "skirt") 204.

Figure 3:
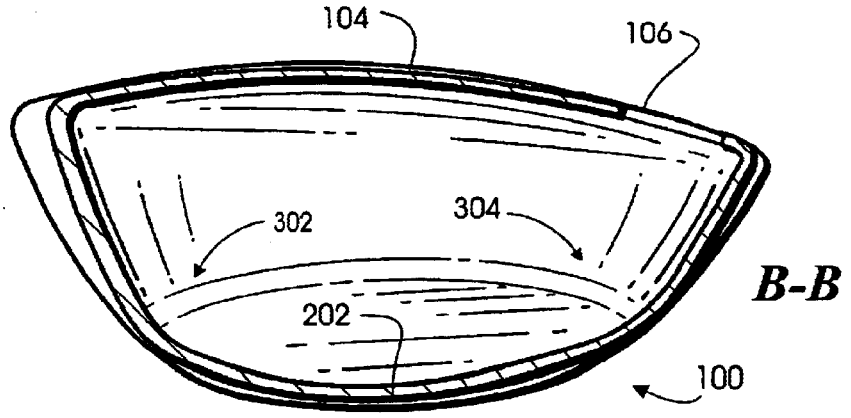
FIG. 3 is a cross-sectional view through section B—B of the club head shown in FIG. 1.

As further shown in FIG. 3, which depicts a cut-away view of cross-section B—B, body 100 has a toe region 302 and a heel region 304. These toe and heel regions 302 and 304 designate areas extending from the front wall 102 rearward to side wall 204. That is, when it is stated herein that a hosel or other structure may be attached to, for example, the heel region of inner surface 202, it should be understood that any such attachment may be made at any point along heel region 304, including a point or points adjacent to side wall 204.

Figure 4:
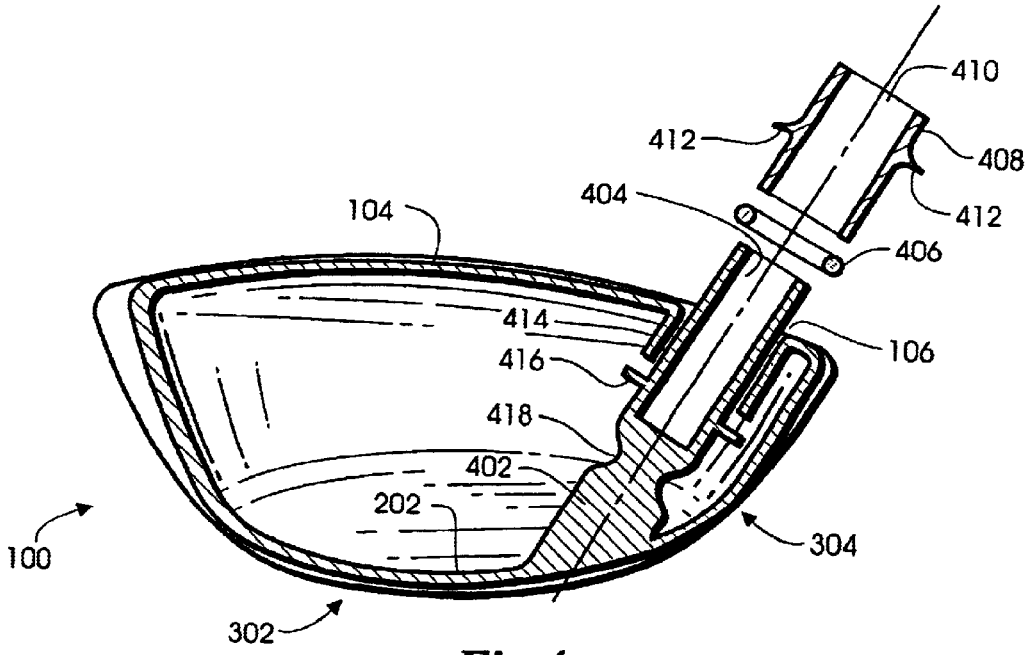
FIG. 4 is a cross-sectional view of a club head in accordance with one embodiment of the present invention.

Referring now to the cross-sectional view shown in FIG. 4, whose orientation corresponds roughly to that of section B—B shown in FIGS. 1 and 3, an exemplary club head includes a hosel 402 that extends from inner surface 202 of heel region 304 upwardly through hosel cavity 106. Hosel 402 may be integral with, bonded to, or otherwise mechanically coupled to inner surface 202 of body 100, and includes an axial bore region 404 configured to receive a golf shaft (shown in FIG. 5).

Hosel 402 preferably extends above hosel cavity 106 by a predetermined distance. In the illustrated embodiment, hosel 402 extends above hosel cavity 106 such that hosel sleeve 408 is coterminous with hosel 402. In a preferred embodiment, hosel 402 extends above hosel cavity 106 approximately ½ to 1 inch.

While hosel 402 is shown connected to the inner surface 202 at the heel region 304 at a point that is collinear with the axis of the shaft (which fits within axial bore 404), the present invention contemplates all possible configurations and connection points for hosel 402. For example, hosel 402 may be attached at heel region 304 near or on the side wall of the club (204 in FIG. 1) while still extending above hosel cavity 106. Moreover, the point at which hosel 402 contacts inner surface 202 may be specified for different types (and lofts) of clubs.

In the illustrated embodiment, an inner cavity section 414 extends inwardly from the perimeter of hosel cavity 106 to co-axially accept a hosel sleeve 408, described in further detail below. Although inner cavity section 414 is illustrated as having a uniformly cylindrical shape, the invention is not so limited. Moreover, the thickness of inner cavity section 414 may be greater than, less than, or the same as the thickness of body 104. Furthermore, inner cavity section 414 may be continuous with body 100 or may comprise a separate component suitably bonded to body 100.

Body 100 comprises any suitable metal, plastic, composite material, or combination thereof selected in accordance with various criteria as described in further detail below. In accordance with one embodiment, for example, body 100 comprises titanium, stainless steel, or aluminum. In a preferred embodiment, body 100 comprises a high-purity titanium alloy, for example, a commercial pure grade 2 titanium. In this regard, while the embodiments discussed herein may be described in the context of a metal club head body, the present invention is not so limited.

Depending upon the selected material or materials, body 100 may be fabricated using any suitable process now known or later developed, including a variety of conventional casting methods such as investment-casting, powdered-metal processing, and/or metal machining. In one embodiment, body 100 is formed via a suitable casting process and thereafter milled to finish the various exposed surfaces. In this regard, conventional investment casting techniques are well known to those skilled in the art and will not be described in detail herein.

Body 100 is defined by any suitable club head shape depending upon any number of factors, including, for example, club head type, desired polar moment of inertia, desired center of gravity, desired aesthetic properties, and/or the desired weight, mass, and density of the club head. In this regard, it will be appreciated that the exemplary club head shapes depicted in FIGS. 1–5 are for illustrative purposes only, and that the present invention is not so limited.

Front wall 102 of body 100 has a suitable thickness that may be substantially constant or may vary across its height and width. The thickness of front wall 102 is selected to provide a suitable response to club head 100 striking a golf ball. In one embodiment, the thickness of front wall 102 has a value ranging from approximately 0.050 inch to approximately 0.130 inch, preferably between 0.070 inch to 0.110 inch.

In the illustrated embodiment, a hosel sleeve 408 (having an inner diameter 410) is configured to fit co-axially over hosel 402 and within inner cavity section 414 to provide the desired mechanical decoupling between these components. Hosel sleeve 408 is preferably bonded to inner cavity section 414 and/or hosel 402, and may be custom-shaped to provide a particular loft or to achieve other geometrical goals. Hosel sleeve 408 preferably includes a lip 412 (e.g., a lip having a predetermined radius) configured to provide a blending contour between top wall 104 and hosel sleeve 408.

Hosel sleeve 408 comprises any suitable material, for example, a plastic or composite material selected to provide the desired amount of mechanical decoupling between top wall 104 and hosel 402. In a preferred embodiment, hosel sleeve 408 comprises polyurethane.

In a preferred embodiment, hosel 402 includes a necked-down region 418 characterized by a lower diameter (or, more generally, smaller cross-section) that allows hosel 402 to be more easily deformed. Such deformation may be desirable, for example, when the orientation of hosel 402, and hence the loft, lie and face angle of the club face, is to be specified by deforming hosel 402 (i.e., by bending at necked-down region 418). Hosel sleeve 408 may be configured to maintain hosel 402 at the correct angle with respect to body 100. In a preferred embodiment, necked-down region 418 has a diameter that is between approximately 50% and 80% of the nominal diameter of hosel 402, preferably about 75%.

In accordance with the illustrated embodiment, hosel 402 includes an annular ring 416 configured to allow a support ring 406 to seat between inner cavity section 414, hosel 402, and the bottom of hosel sleeve 408. Support ring 406 comprises any suitable material, for example, one of a variety of plastic and/or polymeric materials such as rubber, silicone, or the like.

Figure 5:
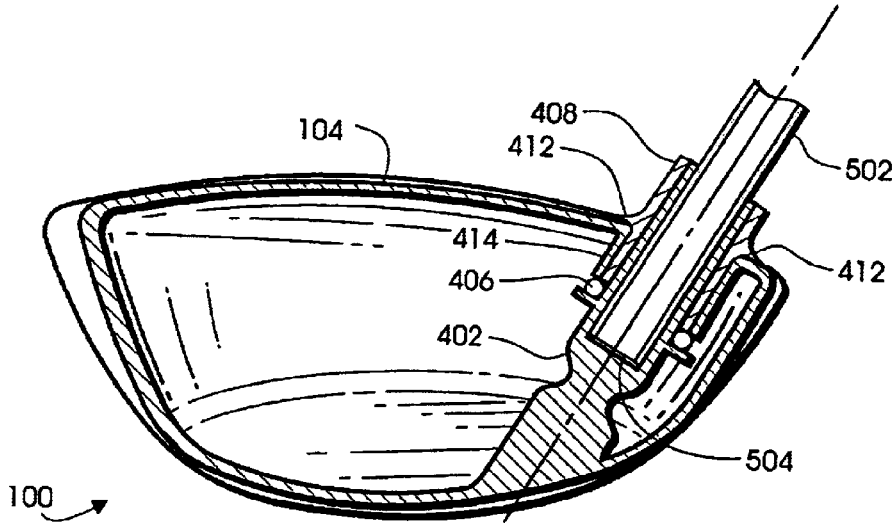
FIG. 5 is a cross-sectional view of the assembled components of a club head as shown in FIG. 4.

FIG. 5 depicts the exemplary golf club head of FIG. 4 after assembly. As shown, support ring 406 is seated at the base of annular ring 416, and hosel sleeve 408 has been inserted within cavity 106 such that lip 412 makes contact with top wall 104. Golf shaft 502 is inserted axially within hosel 402 such that end 504 of shaft 502 makes contact with hosel 402. A grip (not shown) is attached to golf shaft 502 at the opposite end. Suitable adhesives such as epoxies and the like may be used alone or in conjunction with compressive fits to secure the various components in place.

The coefficient of restitution (or "COR") is used to characterize the efficiency of impact between a golf club head and a golf ball, and is often limited by various governing bodies (e.g., the USGA). Regardless of whether a particular club exhibits a COR within a specified range, however, the present invention provides methods for improving the COR of a given club head, all other design factors being equal. In this way, design factors that might be restricted to undesirable ranges in order to achieve a desirable COR (e.g., front wall thickness, material, weight, etc.) may be further optimized to meet other performance goals.

In conclusion, what has been provided is a golf-club head, for example, a wood-type golf club head, having a substantially hollow body wherein the hosel is substantially isolated from the top wall of the body. Although the invention has been described herein in conjunction with the appended drawings, those skilled in the art will appreciate that the scope of the invention is not so limited. For example, while the present invention has been described in terms of wood-type club heads, many other types of golf clubs would profit from the present invention. Moreover, while titanium has been cited as preferred materials for the body, it will be appreciated that any suitable material now known or later developed may be used in connection with the present invention, including various metals, alloys, composites, ceramics, and the like. These and other modifications in the selection, design, and arrangement of the various components and steps discussed herein may be made without departing from the scope of the invention as set forth in the appended claims.

What is claimed is:

1. A golf ball head comprising:

a substantially hollow body having a front wall arranged for impacting a golf ball, a top wall connected to said front wall, a hosel cavity formed in said top wall, a bottom wall having an inner surface, a heel region, and a toe region;

a hosel attached to said bottom wall in said heel region and extending upwardly from the inner surface of said bottom wall through said hosel cavity, said hosel configured to accept a shaft;

a hosel sleeve provided within said hosel cavity between said hosel and said top wall to substantially isolate said top wall from said hosel; and a support ring disposed between said hosel and said substantially hollow body.

2. The golf club head of claim 1, wherein said substantially hollow body comprises a material selected from the group consisting of titanium, steel, and aluminum.

3. The golf club head of claim 1, wherein said hosel extends upwardly from said top wall for a length of between approximately 0.125 inch and 0.750 inch.

4. The golf club head of claim 1, wherein said hosel extends upwardly from said top wall for a length of 0.500 inch.

5. The golf club bead of claim 1, wherein said hosel cavity is substantially circular and has a radius of approximately 0.50 inch to 1.00 inch.

6. The golf club head of claim 1, wherein said hosel sleeve comprises a polymeric material.

7. A golf club head comprising:

a substantially hollow body having a front wall arranged for impacting a golf ball, a top wall connected to said front wall, a hosel cavity formed in said top wall, a bottom wall having an inner surface, a heel region and a toe region:

a hosel attached to said bottom wall in said heel region and extending upwardly from the inner surface of said bottom wall through said hosel cavity, said hosel configured to accept a shaft;

a hosel sleeve provided within said hosel cavity between said hosel and said top wall to substantially isolate said top wall from said hosel, wherein said hosel includes a necked-down region configured to facilitate positioning of said hosel with respect to said substantially hollow body.

8. A method of making a golf club comprising:

providing a club head formed of a substantially hollow body having a front wall arranged for impacting a golf ball, a top wall connected to said front wall and a bottom wall connected to said font wall:

providing a hosel cavity in said top wall of said body;

attaching a hosel to an inner surface of said bottom wall so that said hosel extends upwardly through said hosel cavity;

orienting said hosel relative to said front, top and bottom walls of said body so that said hosel is properly positioned with respect to said body;

providing a hosel sleeve within said hosel cavity between said hosel and said body top wall to substantially isolate said hosel from said body top wall;

inserting one end of a shaft into said hosel; and providing said hosel with a necked-down region to facilitate bending of said hosel for properly positioning of said hosel with respect to said body.

9. A method of making a golf club comprising:

providing a club head formed of a substantially hollow body having a front wall arranged for impacting a golf ball, a top wall connected said front wall and a bottom wall connected to said front wall;

providing a hosel cavity in said top wall of said body;

attaching a hosel to an inner surface of said bottom wall so that said hosel extends upwardly through said hosel cavity;

orienting said hosel relative to said front, top and bottom walls of said body so that said hosel is properly positioned with respect to said body;

providing a hosel sleeve within said hose cavity between said hosel and said body top wall to substantially isolate said hose from said body top wall;

inserting one end of a shaft into said hosel; and providing a support ring between said hosel and said body.

* * * * *